US005152670A

United States Patent [19]

Waldecker

[11] Patent Number: 5,152,670

[45] Date of Patent: Oct. 6, 1992

[54] SUMP SYSTEM

[76] Inventor: Donald E. Waldecker, 1000 Water St., SW., Washington, D.C. 20024

[21] Appl. No.: 511,206

[22] Filed: Apr. 19, 1990

[51] Int. Cl.[5] ..... F04D 27/00

[52] U.S. Cl. ..... 417/38; 417/12; 200/83 T

[58] Field of Search ..... 417/12, 22, 36, 38, 417/40, 423; 200/83 N, 83 T; 340/576; 137/592

[56] References Cited

U.S. PATENT DOCUMENTS

| | | | |
|---|---|---|---|
| 1,529,019 | 3/1925 | Evans | 137/592 |
| 2,687,693 | 8/1954 | Hudson . | |
| 2,777,028 | 1/1957 | Kendall | 73/299 |
| 2,922,854 | 1/1960 | Nielsen | 417/38 |
| 2,956,581 | 10/1960 | Pearson | 417/38 |
| 3,070,021 | 12/1962 | Tutthill . | |
| 3,104,614 | 9/1963 | Gramenzi . | |
| 3,162,737 | 12/1964 | Tutthill . | |
| 3,285,181 | 11/1966 | Howard . | |
| 3,342,135 | 9/1967 | Schnabel, Jr. . | |
| 3,535,479 | 10/1970 | Smyers, Jr. et al. | 200/83 T |
| 3,656,866 | 4/1972 | Hine, Jr. et al. . | |
| 3,776,661 | 12/1973 | Wohnlich | 417/12 |
| 3,941,073 | 3/1976 | Ridgeway .. | |
| 4,171,932 | 10/1979 | Miller | 417/12 |
| 4,275,995 | 6/1981 | Taylor . | |
| 4,709,723 | 12/1987 | Sidaway et al. | 137/592 |

*Primary Examiner*—Richard A. Bertsch
*Assistant Examiner*—David W. Scheuermann
*Attorney, Agent, or Firm*—Burns, Doane, Swecker & Mathis

[57] ABSTRACT

A sump apparatus for use in a marine vessel comprises a tank, a pump communicating with the tank for evacuating the tank, and a pump control mechanism for energizing the pump in response to a predetermined height of water in the tank. That mechanism comprises a housing defining an air chamber, a switch disposed in the chamber and operably connected to the pump, a switch actuating diaphragm mounted in the housing for actuating the switch. An air vent conduit communicates with the chamber, and a flow restrictor desensitizes the diaphragm relative to momentary changes in the water pressure acting on the diaphragm. The pump control mechanism can be mounted in a side wall of the tank, or to a removable top lid of the tank so as to be removable with that lid. The pump control mechanism may include a timer operably connected to the switch and pump for deactivating the pump after a predetermined period of pump operation sufficient to evacuate the tank.

16 Claims, 4 Drawing Sheets

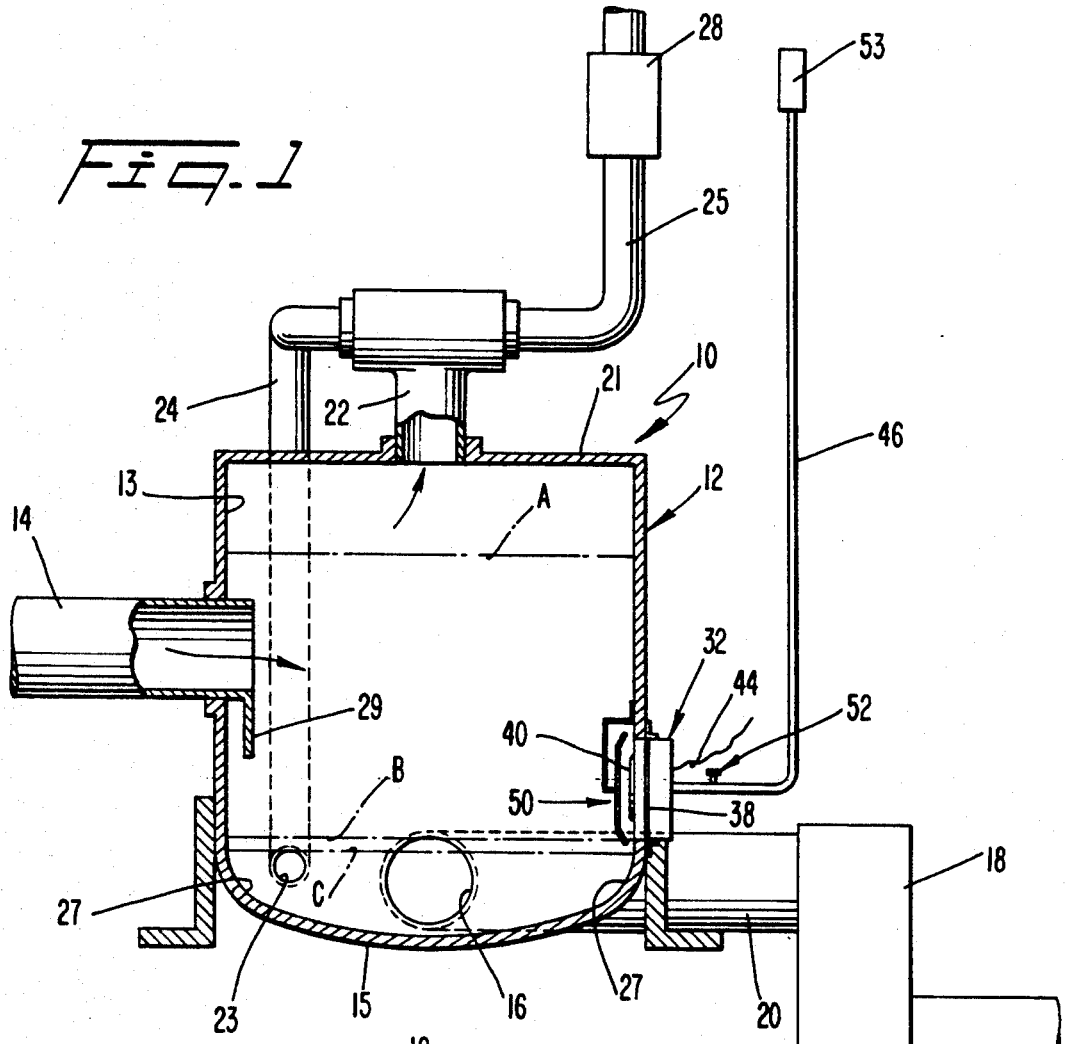
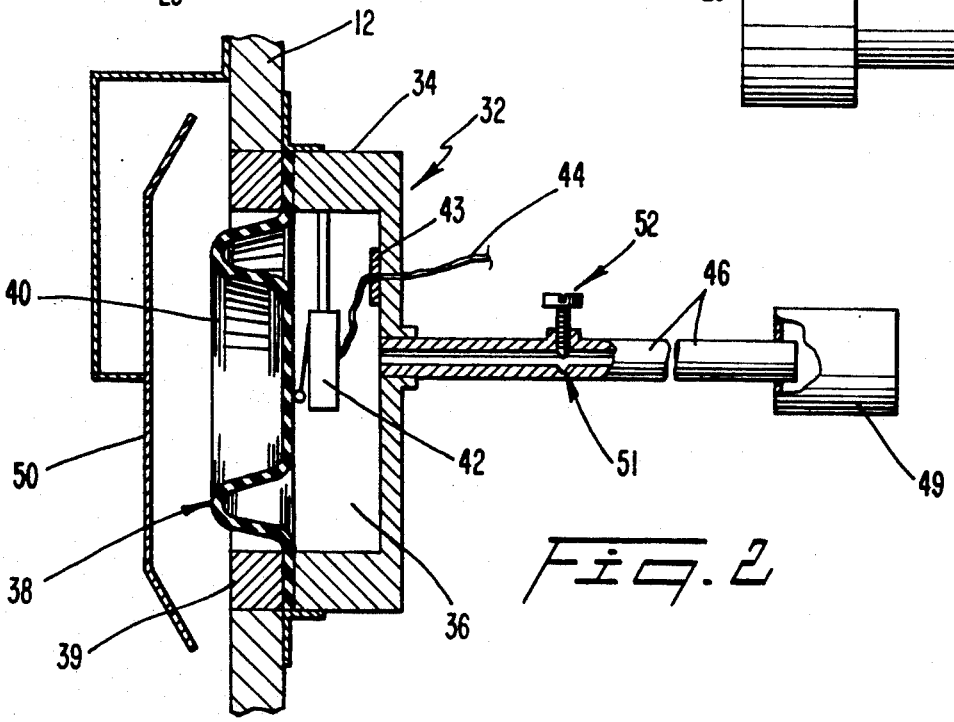
Fig. 2

Fig. 6
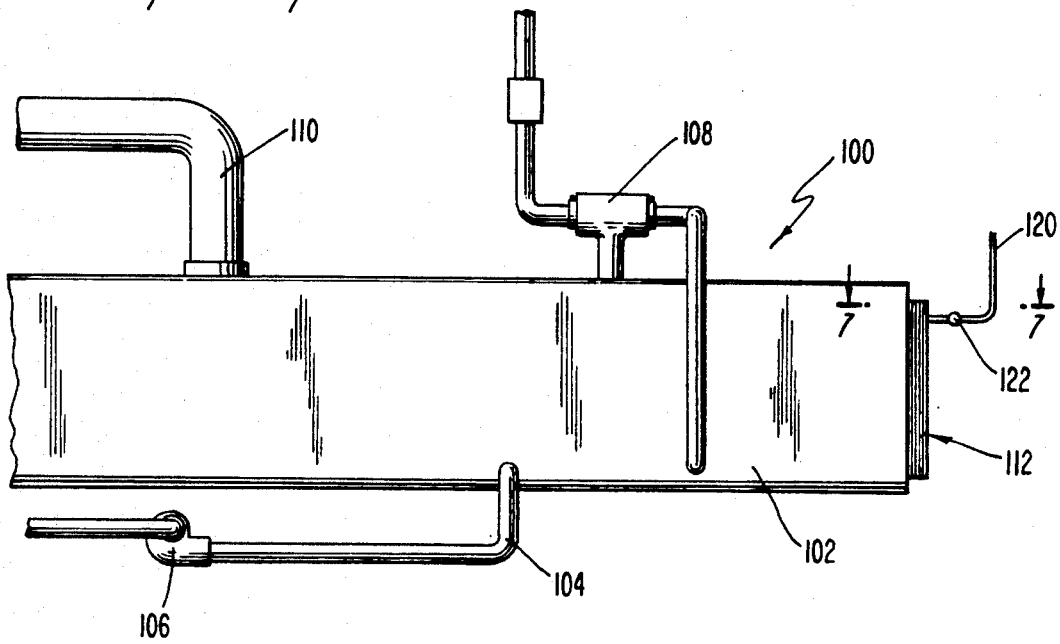
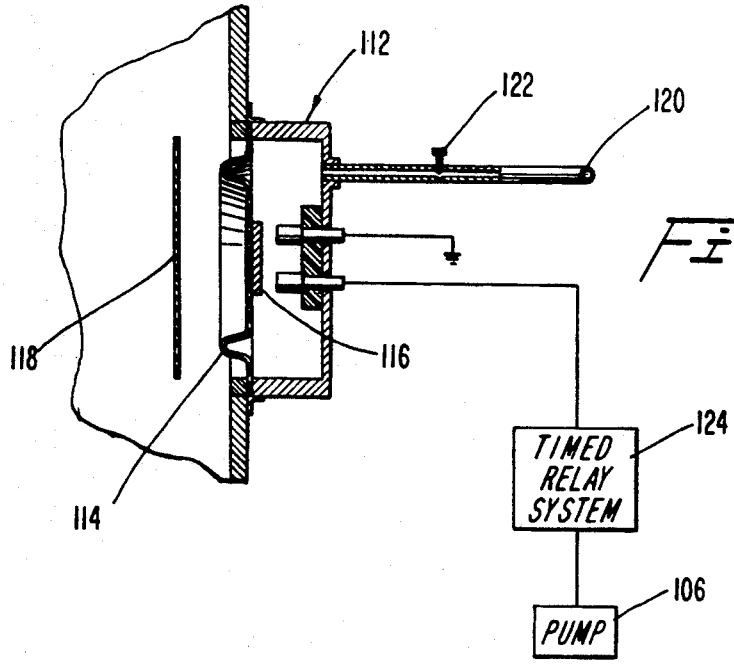
Fig. 7

SUMP SYSTEM

BACKGROUND OF THE INVENTION

The present invention involves sump discharging methods and apparatus, especially for use in a marine vessel.

Marine vessels typically employ sump systems for discharging waste water (i.e., so-called "gray water") from sinks, showers, and the like. A sump system commonly employs a tank having an ingress for water to be discharged, and an egress in communication with a water discharge pump. The pump is energized in response to the sensing of an accumulation of water in the tank by means of a switch.

One type of switch which is currently utilized is a float switch wherein a float is mounted on the end of a lever. As the water rises, the float ascends to rotate the lever (e.g., see U.S. Pat. Nos. 3,941,073 and 4,275,995). When the lever has rotated a predetermined distance, electrical contacts are closed to energize the pump. Problems associated with such a switch involve a tendency for the switch to become fouled by substances in the water, whereupon the switch may tend to stick. Also, the switch is sensitive to momentary increases in water level occurring at the float in response to the motion of the vessel. Consequently, the switch may cycle on and off repeatedly and wear out relatively soon.

A known type of pump control mechanism utilizes a diaphragm which is acted upon and displaced by a water pressure head in the sump tank (e.g., see U.S. Pat. Nos. 2,687,693; 3,070,021; 3,104,614; 3,162,737; and 3,285,181). The diaphragm is associated with the switch so as to actuate the switch and energize the pump in response to a predetermined displacement of the diaphragm. Although such a mechanism may reduce the problems of switch fouling, there remains the problem of the switch being worn out by frequent actuation in response to momentary water level increases due to the motion of the vessel.

Therefore, it would be desirable to provide a sump pump actuating mechanism, especially for use in a marine vessel, which is relatively insensitive to momentary increases in water level. If the degree of such insensitivity could be varied, then the mechanism could be adapted to different types of vessels and different operating conditions. It would also be advantageous if such a mechanism were capable of being oriented in any direction in/on the sump tank, i.e., vertically or horizontally, as desired.

Another problem encountered in connection with the disposal of liquid from marine vessels relates to the fact that many vessels suffer from a lack of available vertical or horizontal space for accommodating a conventional sump system. That is, there may be available only a few inches of height in a bilge area, which height is too short to accommodate a standard height sump tank. It would be desirable to provide a sump system which can be accommodated in such a low space. Also, it would be desirable to provide a sump system in which it is unnecessary to gain access to the side of the tank for maintenance of the pump-energizing switch, whereby the tank can be employed in areas having little available horizontal space.

A further problem encountered in connection with conventional sump systems is the expulsion of undesirable odors from the sump tank into the surrounding atmosphere when the tank is being filled. Conventional sump tanks are open to the surrounding atmosphere either through a fully open or loosely closed tank top, whereby odors may be expelled from the tank into those areas. It would, therefore, be desirable to provide a sump system which avoids the emission of odors into the adjacent atmosphere.

Sump tanks usually require frequent cleaning to remove films, scum, soap residue, dirt particles, hair particles, food particles, etc., which may accumulate therein and which can eventually interfere with proper sump operation as well as produce noxious odors. It is both time-consuming and unpleasant to clean the tank interior, so it would be desirable to provide a self-cleaning sump apparatus.

Yet another problem associated with sump systems on marine vessels occurs when the sump tank is located in a volatile environment, such as a fuel storage area. In such an environment, the variety of pump-energizing mechanisms which can be used is limited, because it would not be permissible to utilize a mechanism of a type which generates electrical sparks that could produce an explosion. It would be desirable, therefore to be able to utilize a pump-energizing mechanism of the spark-generating type while eliminating the risk of explosions.

SUMMARY OF THE INVENTION

The present invention involves a sump apparatus, especially for use in a marine vessel. The apparatus comprises a tank, means for conducting dischargeable water into the tank, and a water outlet for removing water from the tank. A pump communicates with the outlet. That pump control mechanism comprises a housing defining an air chamber, a switch disposed in the chamber and being operably connected to the pump, and a switch-actuating diaphragm mounted in the housing so as to be displaceable in a first direction in response to a predetermined water pressure head in the tank to actuate the switch and thereby energize the pump. An air vent conduit communicates with the chamber. The rate of air flow through the air vent conduit can be changed by a flow restriction to desensitize the diaphragm relative to momentary changes in the water pressure head acting on the diaphragm.

The sump tank is preferably closed in order to minimize the emission of unpleasant odors. The tank air vent line(s) is filtered and/or extended to remote areas to further reduce any odor problems.

The switch air vent conduit can be arranged to exhaust into a closed chamber to isolate a surrounding volatile atmosphere from sparks created by actuation of the switch.

Preferably, a shield is disposed in front of the diaphragm to shield the diaphragm from the impacts of moving water in the tank.

Preferably, the tank includes a bottom wall and upstanding walls. The upstanding walls include an inside surface which join the bottom wall by concavely curved wall portions to minimize the accumulation of solids at the juncture of the bottom wall and the side walls. Residual water is intentionally left in the tank to aid in cleaning the tank as the tank is subjected to vessel motion.

The tank may include a removable upper lid attached to a body of the tank by removable fasteners. The housing of the pump control mechanism is connected to the lid and is spaced downwardly therefrom within the tank. The diaphragm is arranged to face downwardly toward a bottom of the tank. By removing the lid, the pump control mechanism is removed therewith. It is also possible to mount the water outlet conduit, the water inlet conduit, and an air vent to the lid for removal therewith.

The pump control mechanism may include a timing mechanism operably connected to the switch and the pump for deactivating the pump after a predetermined period of pump operation. The timing mechanism can be activated in response to the deactuation of the switch.

BRIEF DESCRIPTION OF THE DRAWINGS

The objects and advantages of the invention will become apparent from the following detailed description of preferred embodiments thereof in connection with the accompanying drawings in which like numerals designate like elements, and in which:

FIG. 1 is a vertical sectional view taken through a sump tank according to a first embodiment of the invention;

FIG. 2 is a vertical sectional view taken through a pump control mechanism depicted in FIG. 1;

FIG. 6 is a side elevational view of a third embodiment of a sump system according to the present invention;

FIG. 7 is a horizontal sectional view taken along line 7—7 of FIG. 6 to depict the pump control mechanism therein.

DETAILED DESCRIPTION OF PREFERRED EMBODIMENTS OF THE INVENTION

Figure 3:
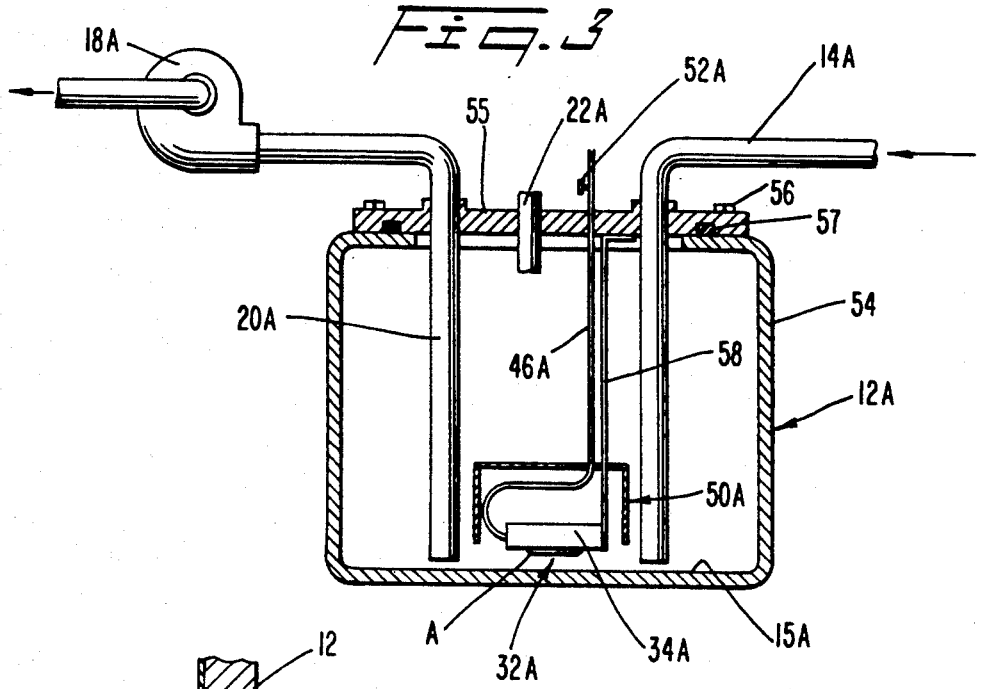
FIG. 3 is a vertical sectional view taken through a second embodiment of a sump tank according to the present invention.

A sump system for use in a marine vessel according to the present invention comprises a tank 12 having a water inlet pipe 14 which receives waste water to be discharged from the boat, such as water from a sink or shower for example. The inlet pipe 14 passes through and beyond an upstanding side surface 13 of the tank, whereby the discharge aperture thereof is spaced inwardly of the side surface 13.

Disposed adjacent a bottom 15 of the tank is a water outlet 16 which communicates with a sump pump 18 by means of a conduit 20. As will be explained hereinafter, the pump is energized to discharge waste water when a switch is acted upon by a pre-set pressure head created by the waste water accumulated within the tank.

An air vent 22 mounted in a top wall 21 of the tank communicates with the tank interior to vent air from the tank as the tank receives waste water. The vent 22 communicates with an air line 25 which discharges the air at a remote location. A filter 28, such as a filter for odor and/or bacteria control, is provided in the air line 25. The air line 25 also permits air to enter the tank when the tank is being emptied, in order to prevent a vacuum from being developed in the tank should the inlet pipe 14 become blocked.

Instead of passing through a top wall of the tank, the vent pipe 22 could pass through a side wall of the tank. In such an event, however, the pipe should extend as far as a vertical center line of the tank to minimize the ability for water to enter the pipe.

An upright conduit 24 communicates with an opening 23 formed near the bottom of the tank 12 and with the vent 22, the latter being in the form of a T-shaped connector. The conduit 24 may be made transparent and oriented exteriorly of the tank to provide a readily visible indication of the water height existing within the tank. The conduit 24 can comprise a flexible hose which is disconnectible from the T-shaped connector 22, e.g., by the removal of a conventional hose clamp, and reconnectible to a pump so as to be usable as an auxiliary discharge line for pumping out the tank if the pump 18 were to become inoperative. If the conduit 24 is intended for use only as an auxiliary pump line, then the conduit 24 could be disposed inside, rather than outside, of the tank.

The tank 12 is closed in the sense that the discharge of air from the tank when the tank is being filled is possible only through the vent 22. By locating the outlet of the air line 25 remote from the vessel's occupants, and/or by filtering the discharging air via the filter 28, it is less likely that disagreeable odors from the tank will be noticed.

The side surfaces 13 of the tank interior are joined to the bottom surface 15 thereof by smooth concave surface portions 27 extending around the entire periphery of the bottom surface 15. As a result, there exist no sharp corners capable of forming stagnant regions in which solids or scum can accumulate. Also, the movement of residual water in the tank resulting from the motion of the vessel will create a scouring action keeping the bottom surface 15 clean. Since the discharge aperture of the inlet pipe 14 is spaced inwardly from the side surface 13 of the tank interior, solids, films, soap scum, etc., being introduced through the pipe 14 will not run down along the side surface 13. This feature is enhanced by the provision of a flange 29 which depends from the inlet pipe 14 to prevent liquids from running back along the underside of the inlet pipe 14 to reach the side surface 13. The flange 29 could comprise a plate fastened to the pipe 14, or it could comprise the flange of a threaded fitting used to attach the pipe 14 to the tank side wall.

Connected to a side wall of the tank is a pump control mechanism 32. That mechanism 32 comprises a housing 34 having an internal air chamber 36 and a diaphragm 38 (see FIG. 2). The outer edge of the diaphragm 38 is attached to the housing 34 by a cover plate 39 which bears against an outer periphery of the diaphragm 38 and is suitably attached to the housing, e.g., by means of screws. As a result, most of the face 40 of the diaphragm 38 is exposed to the interior of the tank 12, whereby the diaphragm 38 is acted upon by the static pressure head created by water in the tank. That pressure head causes the diaphragm 38 to be displaced into the chamber 36. Such displacement of the diaphragm 38 can be opposed solely by the elasticity of the diaphragm 38, or with the aid of a separate spring if desired.

Disposed within the chamber 36 and behind the diaphragm 38 is a microswitch 42 arranged to be actuated by the diaphragm 38 when the water level in the tank reaches such a depth that a predetermined pressure head acts against the diaphragm. As the diaphragm 38 is displaced inwardly, the volume of the chamber 36 is reduced and air is forced from the chamber through an air vent tube 46. The microswitch 42 is electrically connected to a relay 43 which, in turn, is connected to the pump 18 by suitable conductors 44, whereby the pump is energized to pump water from the tank.

Once the operation of the pump has sufficiently reduced the water level, the operation of the pump is terminated. The pump termination can occur immediately in response to an opening of the microswitch 42, or, as will be explained later, it can occur after a predetermined time period. In any event, the arrangement is such that following the operation of the pump, a preset amount of residual water remains in the tank to be moved around by the motion of the vessel in order to continually scour the tank bottom and the diaphragm. In that fashion, the tank is self-cleaning.

The diaphragm switch 32 can be set to energize the pump in response to a water pressure head attained when the waste water reaches a level A in FIG. 1. The pump would be de-energized when a water level B is reached, and during the subsequent slow-down and stoppage of the pump, water would be removed to bring the water level to the final residual level C which is sufficient to clean the diaphragm and the tank bottom when subjected to vessel motion.

Therefore, a combination of features aids in keeping the interior of the tank clean. In that regard, fouling of the side surfaces 13 of the tank is minimized by locating the discharge aperture of the inlet pipe 14 inwardly of the side surfaces and by providing the flange 29 on the inlet pipe 14. The accumulation of solids or scum around the periphery of the tank bottom is prevented by the concavely curved surfaces 27 which cooperate with the sloshing action of the residual water deliberately maintained in the tank 12 following the operation of the pump 18. When water is introduced into the tank, the rising water level will clean the exposed face of the diaphragm.

It will be appreciated that the motion of the marine vessel may cause the tank 12 to become inclined such that water in the tank travels toward the diaphragm 38, whereby the water impact against the diaphragm 38 could become momentarily great enough to cause the pump to be prematurely energized. In order to shield the diaphragm 38 from the impact of moving water in the tank, so that the diaphragm 38 is moved only by static pressure head and not dynamic pressure of the water, a shield 50 is positioned in front of the diaphragm 38 in spaced relationship thereto. That shield dissipates the impact of the moving water, while permitting the static pressure head to act on the diaphragm.

If vessel motion caused the tank 12 to be tilted in a manner directing the water away from the diaphragm 38, the water pressure head at the diaphragm 38 could become momentarily low enough to cause the pump 18 to be prematurely de-energized. Thus, the motion of the vessel could cause the microswitch 42 to cycle on and off at a high frequency so as to rapidly wear out the switch 42. Such momentary increases or decreases in static pressure head at the diaphragm 38 are prevented from producing an excessively rapid displacement of the diaphragm 38 by means of an adjustable restriction 51 in the air vent tube 46 of the chamber 36. The size of the restriction is varied by means of a valve in the form of a threaded pin 52 which can be threaded into or out of the tube 46 to increase or reduce the cross-sectional area thereof. By reducing the cross-sectional area, the rate of escape of air from the chamber 36 is reduced, thereby slowing the rate of travel of the diaphragm 38 toward the switch 42. Consequently, a momentary pressure head acting on the diaphragm 38 will dissipate before the switch 42 can be actuated.

It will also be appreciated that if the momentary pressure change acting on the diaphragm constitutes a pressure drop caused by a flow of the water away from the diaphragm 38, the restriction 51 will restrict the rate of air flow into the chamber 36, thereby inhibiting the displacement of the diaphragm 38 away from the switch 42. Thus, the water pressure can return to its previous level before the pump is de-energized.

Since the restriction 51 is adjustable by the pin 52, the sensitivity of the control mechanism can be varied to conform to the intensity of the vessel/sump motion. Thus, the restriction can be varied so as to initially adapt the sump system to the type of vessel (since a large vessel is less sensitive to the sea conditions than a small vessel) and to the location of the sump tank within the vessel.

Alternatively, the air restriction could be adjusted by changing the length of the tube 46 or by attaching a fixed restrictor such as a filter 53 to the end of the tube as depicted in FIG. 1, which restricts the rate of passage of air into and from the tube. Also, air restriction could be varied by attaching a sealed hollow container 49 (FIG. 2) to the end of the switch vent tube, because the size of the volume of that container will determine the resistance to the egress of air from the vent 46.

It will thus be appreciated that according to the present invention the pump 18 will be energized solely in response to a true static pressure head within the tank despite rolling or pitching motions of the vessel. This reduces the cycling and rate of wear of the switch 42 and pump 18.

In some instances the tank 12 may be located in a volatile environment, such as an area where fuel is stored. An explosion could result if the fuel vapor-laden atmosphere is ignited by the electric spark which is generated when the microswitch 42 is closed by the diaphragm 38. To avoid that risk, the present invention involves the mounting of the afore-mentioned closed hollow container 49 at the end of the tube 46 (FIG. 2). The internal volume of the container 49 receives air from the tube 46 in order to permit the diaphragm to be displaced, while isolating the surrounding atmosphere from any sparks generated by the microswitch. Therefore, the risk of explosions is minimized.

Another embodiment of the invention will now be described in connection with FIG. 3. That embodiment is intended for use in vessels which do not have sufficient horizontal space to provide access to the sides of the tank. In other words, it would be difficult if not impossible to remove the pump control mechanism 32 from the tank 12 if that mechanism were mounted in a tank side wall.

As can be seen in FIG. 3, the tank 12A includes a body portion 54 and a top lid 55 removably attached to the body portion 54 by releasable fasteners such as screws 56. An air seal is created between the lid 55 and the tank body portion 54 by means of an elastic 0-ring 57 or other sealing agent mounted in the lid.

Attached to the lid and depending downwardly therefrom is a bracket 58 which carries a pump control mechanism 32A which is similar in construction to the earlier described mechanism 32, except that the housing 34A is arranged so that the diaphragm 38A faces downwardly toward the bottom 15A of the tank body portion. A shield 50A is connected to the bracket 58 to partially surround and protect the housing 34A. An air vent tube 46A extends from the housing 34A and exits through the lid 55. An adjustable pin 52A or a fixed resistor in that tube 46A enables the rate of air flow to be varied in the manner described earlier in connection with FIGS. 1 and 2. A vent 22A is carried by the lid 55 to vent the tank interior as the tank is being filled with water. Mounted to the lid is an outlet conduit 20A which extends to the bottom of the tank 12A and communicates with a pump 18A for evacuating the tank 12A.

The operation of the sump system described in connection with FIG. 3 is similar to that described in connection with the embodiment of FIGS. 1 and 2. The diaphragm 38A will be subjected to the upward force resulting from the static water pressure head in the tank 12A and thus will be displaced upwardly to actuate the switch 42. Since the diaphragm 38A will be constantly immersed in the water and will not be forced upwardly by side-to-side wave action of the water in response to motion of the vessel, there is no need to provide a shield beneath the diaphragm 38A.

It will be appreciated that by removing the lid 55 from the tank body 54, all of the water control elements 14A, 32A, 46A, 22A, and 20A will be removed as well, thereby enabling those elements to be replaced, cleaned, repaired, etc., even though there exists no access to the sides of the tank.

Figure 5:
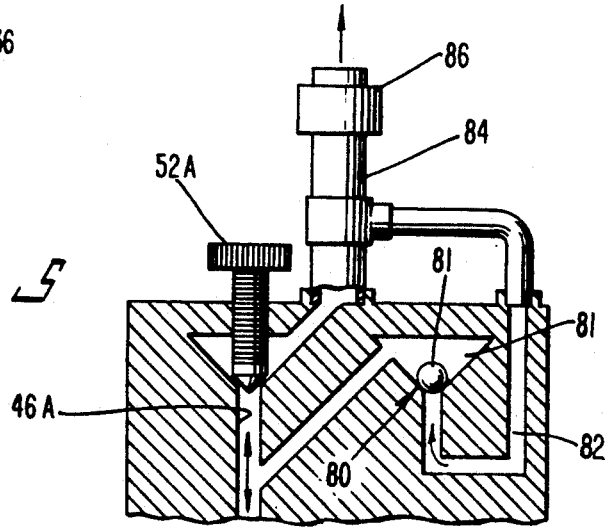
FIG. 5 is a sectional view taken through a modified air venting arrangement which vents air from the pump control housing chamber.

In a situation such as depicted in FIG. 2 it is possible under certain rough seas that the diaphragm could be forced partially toward the switch 42 and then receive another impact before having returned all the way to its rest position, thereby resulting in an actuation of the switch 42. In order to minimize the chances for this to occur, there would be provided means which facilitates movement of the diaphragm 38A to its rest position. In that regard, there is depicted in FIG. 5 a one-way check valve 80 arranged in conjunction with an adjustable vent valve 52A disposed in a vent line 46A. The check valve includes a ball 81 located in a bypass line 82 which communicates an outlet duct 84 with the vent 46A. Air flow is permitted from the outlet duct 84, past the ball 81, and to the vent 46A (thereby by-passing the valve 52A) but not in the opposite direction. Thus, the check valve 80 permits a more rapid movement of the diaphragm 38A to a switch-deactuating position than to a switch-actuating position.

A filter 86 is situated in the outlet duct 84 to restrict the ingress of dust and the like which could foul the valves 52A or 81.

Figure 4:
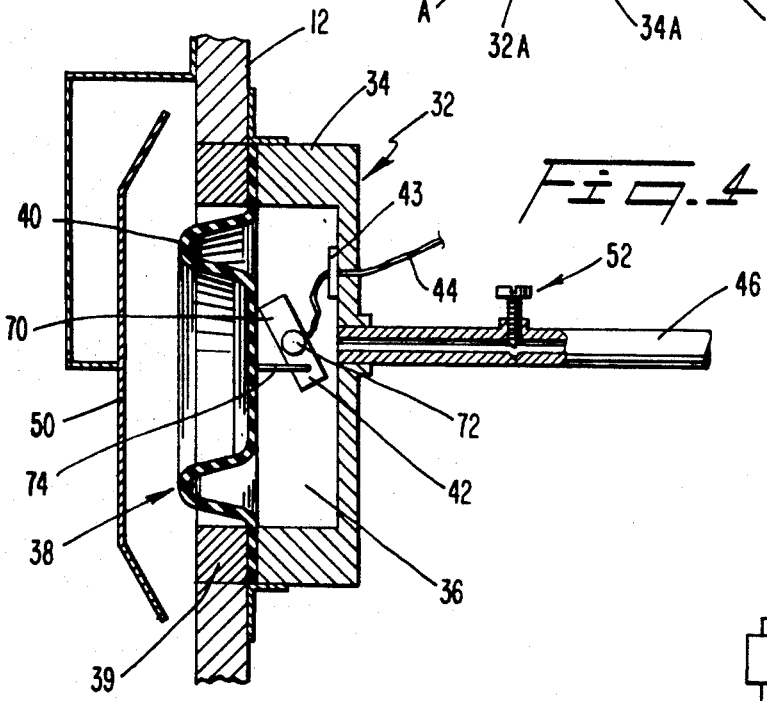
FIG. 4 is a vertical sectional view through a modified pump control mechanism according to the present invention.

A modified version of a pump-energizing switch is depicted in FIG. 4 wherein a conventional mercury switch 70 is employed in lieu of a microswitch. The mercury switch rotates about a pivot 72, the rotation produced by an arm 74 which is fastened to the diaphragm 38 and pivotably connected to the mercury switch. Since the mercury switch is self-contained, it is not necessary to seal the vent tube 46 in volatile environments as the atmosphere is not exposed to a switch spark.

Another embodiment of the invention, depicted in FIGS. 6 and 7, is intended mainly for use in a marine vessel having no available space of sufficient height for receiving a conventional sump tank. A sump system 100 depicted in those figures comprises a very low tank 102, e.g., a tank of only a few inches in height and much longer in length and/or width. Connected to the tank 102 is a conduit 104 for evacuating the tank by means of a suitable pump 106, similar to the earlier described arrangement. A vent arrangement 108, also similar to that which was described earlier, is connected to the tank 102. The tank 102 is sealed in order to prevent the escape of fumes to the immediately surrounding atmosphere. A water inlet pipe 110 is provided to conduct water to the tank from a remote location such as a sink, shower, or the like.

Also provided is a diaphragm-actuated switch 112. The switch 112 is generally similar to those which have been earlier described in that a diaphragm 114 is arranged to be activated by water disposed within the tank in order to actuate the pump 106. The diaphragm 114 carries a conductive plate 116 which is arranged to bridge a pair of electrical contacts 118 when the diaphragm 114 is displaced by water pressure. In so doing, an electrical circuit is energized to actuate the pump 106. The diaphragm 114 is displaced to close the contacts 118 when a predetermined water pressure head is reached. A suitable resistance to displacement of the diaphragm 114 is established, such as by an air vent tube 120 having an adjustable pin 122 or fixed resistor for varying the cross-sectional area of the tube, similar to the earlier described pin 52. If desired, a spring could be provided to bias the diaphragm 114 away from the contacts.

It will be appreciated that if the pump operation were terminated in response to movement of the switch 112 to a deactuated position (i.e., by disengagement of the plate 116 from the contacts 118) as in the earlier described switch embodiments, the pump 106 would likely not sufficiently evacuate the tank 102 and would cycle on and off. That is, due to the low height of the tank 102, the pressure head defined by water in the tank 102 may not be sufficient to hold the switch 112 closed when the water level begins to drop. Thus, a substantial amount of water would remain in the tank 102.

To avoid such a problem, the pump energizing mechanism includes a timing relay 124 which is activated by the switch 112 so as to run the pump 106 for a preselected time period which is predetermined for achieving a voiding of the tank 102. An embodiment of such a timed system is disclosed in connection with FIG. 8.

The pump 106 is actuated as soon as the contacts 118 are closed and the timer 124 is activated upon a reopening of the contacts 118 (i.e., upon a deactuation of the switch 112). The discharge of water from the source to the tank 102 will fill the tank 102, causing the diaphragm 114 to close the contacts 118. As a result, the pump 106 will be operated, but the timed relay system 124 will not be activated. The pump 106 is thus able to discharge water from the tank 102 as the tank continues to receive water from the source. Eventually, all water from the source will have entered the tank 102 through the inlet line 110, whereupon the water level in the tank 102 will begin to fall. The falling pressure head will enable the diaphragm 114 to snap back to its rest position, thereby opening the contacts 118. In response to the contacts 118 being opened, the timed relay system 124 is activated in order to ensure that the pump 106 operates for an additional time period equal to the predetermined period for evacuating the tank 102, except for the residual water suitable to achieve the aforedescribed self-cleaning action.

Having described the functions of the timed relay system 124, the operation of the system 124 will now be described with reference to its constituent parts. The timed relay system 124 includes two relays 130 and 132, a solid state timer 134 and a switch 138. The switch 138 has three positions corresponding to an automatic mode, an off mode and a manual mode. The off mode simply means that the voltage potential B+ is not connected to the relay system 124. In the manual mode, the voltage potential B+ is applied directly to the sump pump 106, thereby bypassing the switch 112, relays 130, 132, and timer 134 altogether, to activate the pump 106 manually. The automatic mode will be explained as follows.

When the switch 138 is in the automatic sump pump activation mode, (marked "AUTO"), a high potential B+ is present at relay contacts 1, 7 and 8 of the first relay 130. The first relay 130, as well as the rest of the relay system 124, may be protected by a fuse 140 or suitable circuit breaker.

Figures 8, 8A:
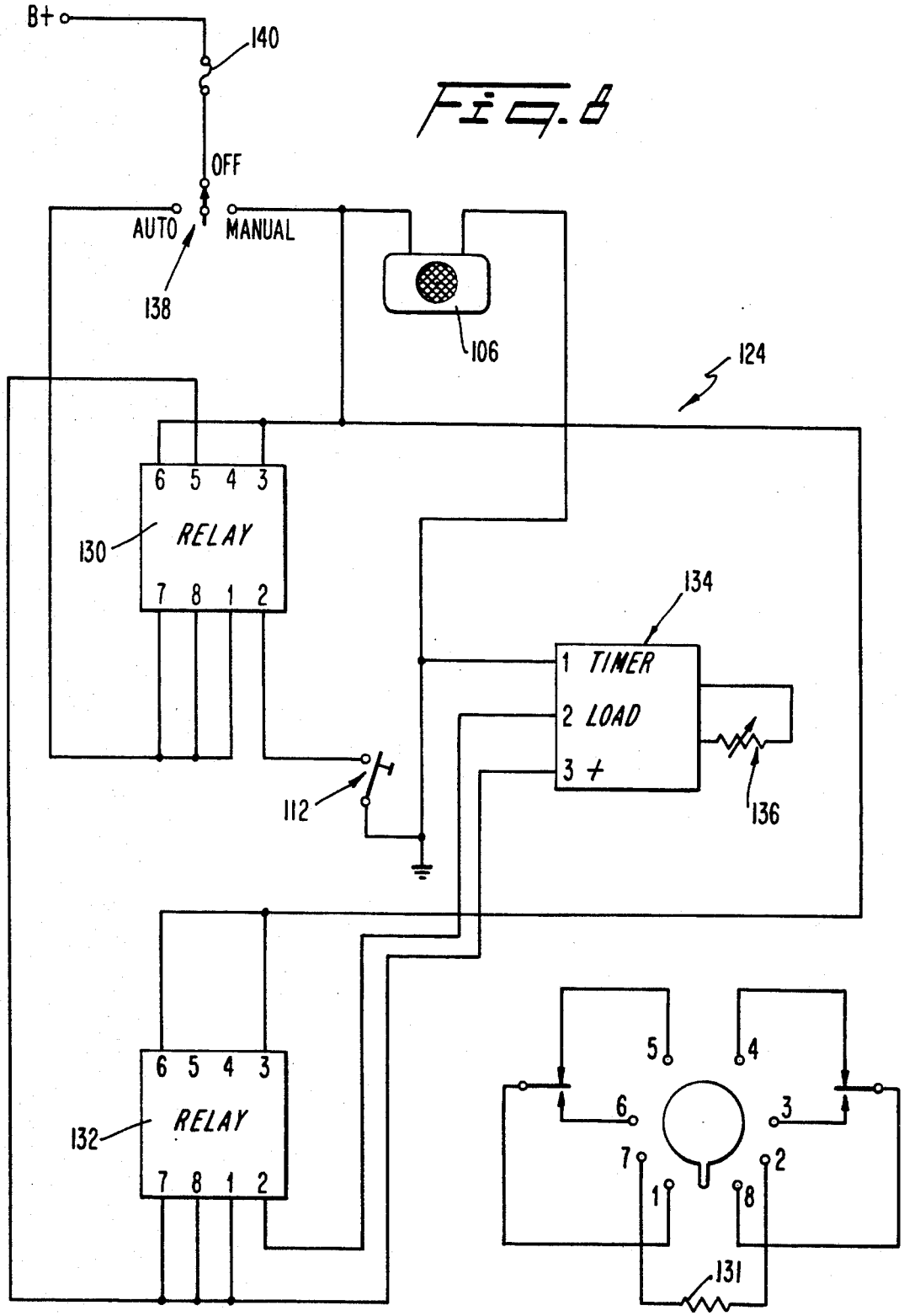
FIGS. 8 and 8*a* are schematic diagrams of the timed relay system of FIG. 7.

The high potential B+ powers relay contacts 1 and 8 as well as contact 7 of the relay solenoid 131 as shown in FIG. 8*a*. The other contact 2 of relay solenoid 131 is connected to ground through the switch 112 so that when the water level is sufficiently high to activate the switch 112, the solenoid 131 is activated. When the solenoid 131 is activated, relay contacts 1 and 8 are brought into contact with transfer contacts 6 and 3, respectively. As can be seen in FIG. 8, when the relay 130 is activated, potential B+ is applied to the sump pump 106 and the pump 106 is actuated.

When the switch 112 is deactivated due to a drop in the water level, the relay solenoid 131 de-energizes and the relay contact 1 is disconnected from transfer contact 6 and brought into contact with transfer contact 5 thereby applying potential B+ to contacts 1, 7 and 8 of the second relay 132 as well as to the enable port 3 of the solid state timer 134. Since the timer 134 is an initiate and time type timer, when the potential B+ is applied to it, the timer 134 commences its counting period. The timer period may be altered by way of the continuously adjustable resister 136 so as to accommodate the various system parameters and to assure that the pump 106 operates only so long as desirable. As evident from the schematic, the timer period is initiated and the pump 106 is activated when the mode switch 138 is placed in the AUTO mode. This provides an opportunity to check the duration of the timer by simply comparing the duration of the pump run, and thereby the duration of the timer period, to an external time reference, such as a stop watch.

During the timer period, contact 2 of the second relay 132, which is internally configured identically to relay 130 (as shown in FIG. 8), is brought to ground because the contact 1 and 2 of the timer 134 are shorted during the timer period. So long as the timer 134 is counting, the solenoid 131 of the second relay 132 is activated. When the solenoid 131 is activated, relay contacts 1 and 8 are connected to transfer contacts 6 and 3 respectively, thereby continuing the operation on the sump pump 134 for the duration of a predetermined period after the switch 112 has been deactivated. This assures that the pump is operated for a predetermined time after the switch 112 has been deactivated.

In the embodiments of FIG. 8, double pull, double throw relays are used in the redundant configuration. This assures that if one of the transfer contacts fails, the entire timer relay system 124 does not necessarily fail. However, any suitable relay may be used in light of the considerations of cost and reliability.

It may be desirable to adjust the duration of the predetermined period so that the pump is run dry for a limited period thereby purging the tank 12 along with air lines 25 and 46 of odoriferous gas thus further assuring that the user does not encounter unpleasant fumes.

While the features of the relays 130, 132 and the timer 134 provide significant advantages to the sump pump system 124, one or more may be eliminated. For instance, the time period may be eliminated by simply omitting the timer 134 and relay 132 and their associated connecting lines from the embodiment shown in FIG. 8 thereby leaving only the switch 138, the relay 130, the switch 112 and the sump pump 106. Alternatively, even the relay 130 may be omitted by simply interposing the switch 112 between the contact corresponding to the automatic mode in the switch 138 and the pump 106 as a series connected switch.

It will be appreciated by skilled artisans that various other circuit elements may be included in the schematic of FIG. 8 without departing from the spirit or scope of the invention. For instance, isolation circuits or other suitable input/output circuits may be added to accommodate various circuit parameters and provide further circuit protection. Alternatively or additionally, indicator lights may be added to indicate the state of the circuit operation. Other alternatives will no doubt occur for the ordinary artisan reading the above specification.

It will be appreciated that in accordance with the present invention a unique sump system is provided which is particularly advantageous if used in a marine vessel. The sump tank is virtually self-cleaning so as to avoid the need to open up and clean the tank. The ability of the tank to repeatedly cycle on and off in response to momentary increases or reductions in static pressure head of the accumulated water is eliminated by the vented nature of the switch chamber. The adjustability of the venting, e.g., by a screw 52, or selected restrictions, enables this feature to be adapted to the particular vessel in question.

Various sump tank designs and pump operation are disclosed which enable the tank to be used in spaces even if there is little vertical height, or little horizontal room available.

The risk of explosions is minimized by the feature wherein surrounding volatile atmospheres are isolated from switch sparks.

The sump system is virtually odorless since the tank is closed and the air vents are filtered or extended to remote locations.

Although the present application has been described in connection with preferred embodiments thereof, it will be appreciated by those skilled in the art that additions, substitutions, modifications, and deletions not specifically described may be made without departing from the spirit and scope of the invention as defined in the appended claims.

What is claimed is:

1. A sump discharging apparatus comprising:

a tank including a tank body and a removable top lid, said lid secured sealingly to said tank body by releasable fastening means, an inlet opening extending through said tank for conducting dischargeable water into said tank, a water outlet extending through said tank for removing water from said tank, a pump communicating with said outlet for evacuating said tank, and a pump control mechanism for energizing said pump in response to a predetermined height of water in said tank, comprising:

a housing connected to said tank and disposed within said tank near a bottom wall of said tank body, a switch disposed in said chamber and being operably connected to said pump, a switch-actuating diaphragm mounted in said housing and arranged to face downwardly toward said bottom wall so as to be displaceable upwardly in response to a predetermined water pressure head in said tank to actuate said switch and thereby energize said pump, and means for terminating the operation of said pump such that following the operation of said pump a predetermined amount of residual water remains in said tank which is subjected to the motion of the vessel to clean said tank and said diaphragm.

2. A sump apparatus according to claim 1, wherein said switch comprises a mercury switch.

3. A sump discharging apparatus according to claim 1, wherein said housing is connected to said lid.

4. A sump apparatus according to claim 1, wherein said tank interior includes upstanding side surface means and a bottom surface joined to said side surface means by a surface portion which is curved from said side surface means to said bottom surface.

5. A sump apparatus according to claim 1 including a filtered air vent connected to said tank for conducting air from said tank as said tank receives water.

6. A sump apparats according to claim 1, wherein said switch comprises a microswitch.

7. A sump apparatus according to claim 1, wherein said tank interior includes upstanding side surface means and a bottom surface, said water inlet means being spaced inwardly from said side surface means.

8. A sump apparatus according to claim 7, wherein said water inlet means comprises an inlet pipe extending through and beyond said side surface means.

9. A sump apparatus according to claim 1, wherein said housing is connected to said lid.

10. A sump apparatus according to claim 9, wherein said water outlet comprises a conduit mounted to said lid and extending downwardly into said tank.

11. A sump apparatus according to claim 10, wherein said inlet means comprises an inlet conduit connected to said lid.

12. A marine vessel sump discharging apparatus comprising:

a tank located in the marine vessel, inlet means for conducting dischargeable water into an interior of said tank, a water outlet communicating with said tank interior for removing waste water from said tank and discharging the removed water off the vessel, a pump communicating with said outlet for pumping waste water through said outlet, and a pump control mechanism for engaging said pump, comprising:

a housing defining an air chamber, a switch disposed in said chamber and being operably connected to said pump, a switch-actuating diaphragm mounted in said housing so as to be displaceable in a first direction in response to a predetermined pressure produced by water build-up in said tank to actuate said switch and thereby energize said pump, an air vent conduit communicating with said chamber, and means for terminating the operation of said pump such that following the operation of said pump a predetermined amount of residual water remains in said tank which is subjected to the motion of the vessel to clean said tank and said diaphragm.

13. A sump discharging apparatus according to claim 12, including an adjustable regulating valve for varying the cross-sectional area of said air vent conduit.

14. A sump apparatus comprising:

a tank, inlet means for conducting dischargeable water into an interior of said tank, a water outlet communicating with said tank interior for removing water from said tank, a pump communicating with said outlet for pumping waste water through said outlet, and a pump control mechanism for energizing said pump comprising:

a housing defining an air chamber, a switch disposed in said chamber and being operably connected to said pump, a switch-actuating diaphragm mounted in said housing so as to be displaceable in a first direction in response to a predetermined pressure produced by water build-up in said tank to actuate said switch and thereby energize said pump, an air vent conduit communicating with said chamber, and restrictor means for controlling the rate of air flow through said air vent conduit to desensitize said diaphragm relative to momentary changes in the water pressure head acting on said diaphragm, said restrictor means comprising a sealed hollow container on an outlet end of said air vent conduit.

15. A sump apparatus comprising:

a tank, inlet means for conducting dischargeable water into an interior of said tank, a water outlet communicating with said tank interior for removing water from said tank, a pump communicating with said outlet for pumping waste water through said outlet, and a pump control mechanism for energizing said pump comprising:

a housing defining an air chamber, a switch disposed in said chamber and being operably connected to said pump, a switch-actuating diaphragm mounted in said housing so as to be displaceable in a first direction in response to a predetermined pressure produced by water build-up in said tank to actuate said switch and thereby energize said pump, an air vent conduit communicating with said chamber, and timer means for operating said pump for a preselected time period and arranged to be activated upon a deactuation of said switch, said timer means including a first relay being activated by an actuation of said switch for activating a second relay; said second relay being activated upon deactuation of said first relay for operating said pump; and a timer activated upon deactivation of said first relay for maintaining the actuation of said second relay for a predetermined time period.

16. A sump apparatus comprising:

a tank, inlet means for conducting dischargeable water into an interior of said tank, a water outlet communicating with said tank interior for removing water from said tank, a pump communicating with said outlet for pumping waste water through said outlet, and a pump control mechanism for energizing said pump comprising:

a housing defining an air chamber, a switch disposed in said chamber and being operably connected to said pump, a switch-actuating diaphragm mounted in said housing so as to be displaceable in a first direction in response to a predetermined pressure produced by water build-up in said tank to actuate said switch and thereby energize said pump, an air vent conduit communicating with said chamber, a closed container disposed at an end of said air vent conduit for isolating said switch from an atmosphere surrounding said tank.

* * * * *